United States Patent [19]

Ludwig

[11] 4,038,960

[45] Aug. 2, 1977

[54] ARROW HOLDER

[76] Inventor: James E. Ludwig, 4063 Ensign Ave. North, New Hope, County of Hennepin, Minn. 55427

[21] Appl. No.: 576,622

[22] Filed: May 12, 1975

[51] Int. Cl.[2] ..... F41B 5/00

[52] U.S. Cl. ..... 124/41 A; 124/24 R

[58] Field of Search ..... 124/41 A, 30 R, 24 R, 124/18, 22

[56] References Cited

U.S. PATENT DOCUMENTS

| | | | |
|---|---|---|---|
| 2,743,716 | 5/1956 | Wendt | 124/41 A |
| 3,153,406 | 10/1964 | Pemble | 124/41 A X |
| 3,499,414 | 3/1970 | Frydenlund | 124/24 R |
| 3,669,059 | 6/1972 | Stuart | 124/30 R X |

*Primary Examiner*—Richard C. Pinkham
*Assistant Examiner*—William R. Browne
*Attorney, Agent, or Firm*—Keith B. Davis

[57] ABSTRACT

An arrow holder including a bifurcated end cooperating with a bow side or arrow rest to continuously hold an arrow in emplacement under virtually every condition including while a bow and strung arrow are being carried about in a non-shooting position, while an arrow is being drawn to a fully-drawn position, and while an arrow is being held in a fully-drawn position. Upon release of an arrow, forward movement of the arrow operates to break the cooperation between the bifurcated end and bow side or arrow rest and release an arrow for free flight.

15 Claims, 13 Drawing Figures

FIG. 6
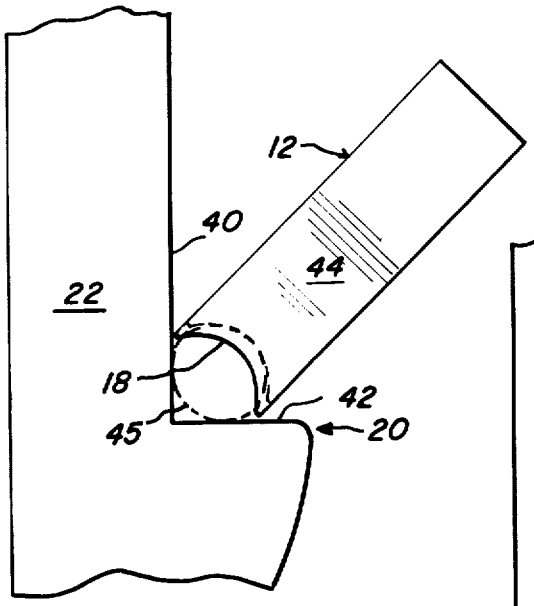
FIG. 13
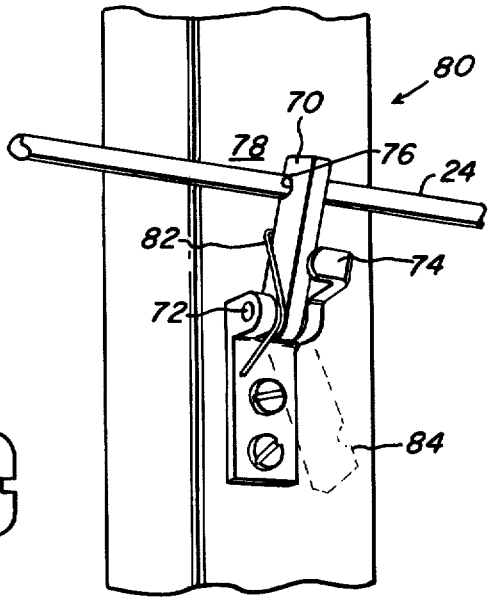
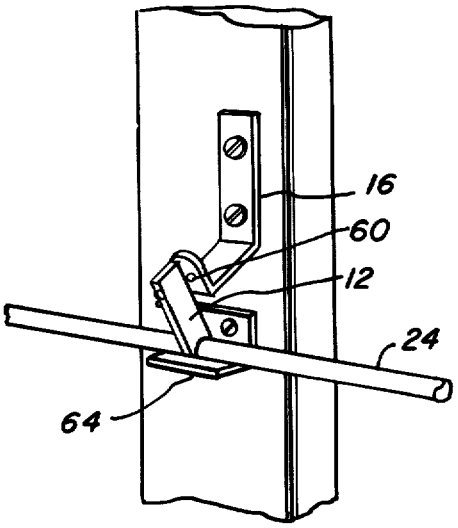
FIG. 12
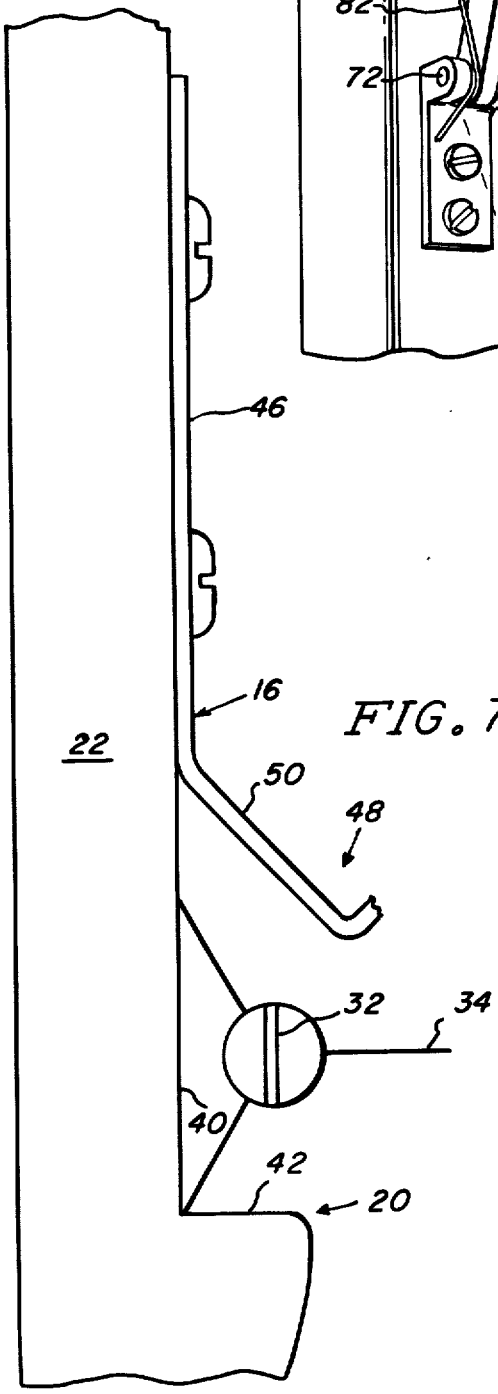
FIG. 7

ARROW HOLDER

BACKGROUND and FIELD of the INVENTION

Briefly, the invention relates to archery equipment in general and to those archery devices known as arrow holders in particular.

Continuous arrow emplacement from the time an arrow is first strung until it is shot is extremely important to certain and of some importance to virtually all archery activities. For purposes of this description, "emplacement" means a position of an arrow in which the arrow nock properly engages the bow string and the arrow shaft rests upon the arrow rest (or archer's knuckles or finger if the bow doesn't include an arrow rest). Continuous emplacement is perhaps most important for certain forms of target shooting known as shooting "rounds", and for game hunting. One form of "round" target shooting consists of a plurality of targets which may be placed along a course on terrain including heavy brush, woods, hills, creeks and all manner of natural obstacles. Targets may also be placed to surprise a contestant to provide a test of reflex action shooting skill. According to one version of scoring such round target shooting, a contestant is timed for the length of time required to traverse the course from start to finish and shoot at each target in sequence. In addition to this time, a contestant's total score is also based on his shooting accuracy. Having an arrow continuously in emplacement after racing along difficult terrain, particularly upon suddenly being confronted with a target, is obviously important to either or both reducing a contestant's time or increasing the accuracy of a shot. Game hunting can also include the elements of reflex action shooting and rough terrain which makes it difficult if not impossible for a hunter to continuously have an arrow ready to be drawn and shot without the aid of an arrow holder. For inexperienced archers, means which provide continuous arrow emplacement is important even for passive activities such as archery range target shooting. To illustrate, an inexperienced archer will sometimes cause an arrow shaft to move sideways while drawing the arrow to a fully-drawn position, causing the arrow to drop downwards or otherwise frustrate completion of the shot.

An object of the present invention is an arrow holder for providing correct arrow emplacement.

Another object of the present invention is an arrow holder which continuously provides correct arrow emplacement while a bow and strung arrow are being carried about in a non-shooting position, while an arrow is being drawn to a fully-drawn position, and while an arrow is being held in a fully-drawn position.

A further object of the present invention is an arrow holder which releases an arrow for free flight in response to forward movement of an arrow shaft.

An additional object of the present invention is an arrow holder substantially free of interference to free flight of an arrow.

Still another object of the present invention is an arrow holder which after an arrow is strung is responsive to an initial forward movement of the arrow to increase the holding force applied to the arrow and oppose unstringing of an arrow.

BRIEF DESCRIPTION of INVENTION

Briefly, the invention comprises a holding means including a bifurcated end adapted for holding an arrow shaft and pivot means for providing pivotal movement of the holding means between positions providing engagement and disengagement of the bifurcated end with and from an arrow shaft. The bifurcated end holds an arrow shaft in cooperation with a bow member, either an arrow rest or a side of the bow. Upon shooting an arrow, the holding means pivots to break the cooperation between the bifurcated end and the bow member and release an arrow into free flight.

According to a preferred embodiment of the invention, the holding means comprises an elongate strip of urethane of generally rectangular cross-section pivotally secured to a V-shaped appendage of a mounting bracket. The strip includes an arcuate notch as the holding means bifurcated end. The arcuate notch is aligned with an arrow rest to form a containment the cross-section of which is sufficiently smaller than the diameter of an arrow shaft to bow the urethane strip when an arrow shaft is inserted into the containment. The bow in the strip exerts a spring-like holding force on the arrow shaft. The initial forward movement of an arrow shaft pivots the holding means to disengage the bifurcated end from the arrow shaft.

An alternative embodiment for a bow without an arrow rest includes a holding means in which the bifurcated end is oriented towards the bow side for holding an arrow against the bow side. Release of an arrow for free flight is in response to an initial forward movement of the arrow which provides a corresponding forward movement followed by lateral pivotal movement of the holding means to completely release the arrow for free flight.

BRIEF DESCRIPTION of DRAWINGS

FIG. 6 is a fragmentary side view of the arrow holder of FIG. 1;

FIG. 7 is another fragmentary side view of the arrow holder of FIG. 1;

FIG. 12 is a perspective view of an arrow holder according to FIG. 1 illustrated with reference to a bow having a removable arrow rest; and, FIG. 13 is a perspective view of an alternative embodiment of an arrow holder according to the present invention.

In the drawings, FIGS. 5 through 11 are to scale.

DETAILED DESCRIPTION of DRAWINGS

Figure 1:
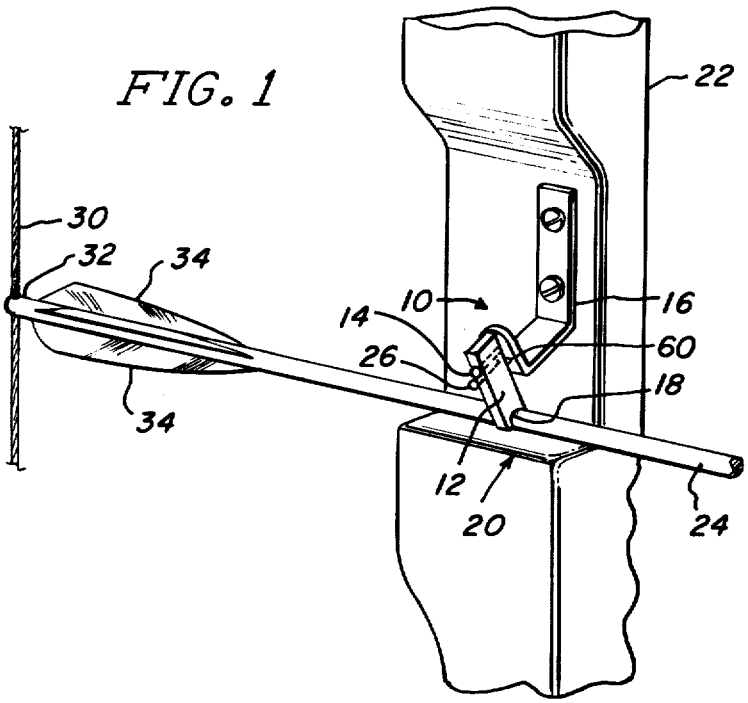
FIG. 1 is a perspective view of an arrow holder according to the present invention.

With reference to FIG. 1, an arrow holder is shown generally as 10. Arrow holder 10 comprises holding arm 12 secured by pivot pin 14 to mounting bracket 16. Holding arm 12 includes an arcuate notch 18 which cooperates with an arrow rest shown generally as 20 of bow 22 to hold an arrow shaft 24 to provide correct emplacement of an arrow. Arrow holder 10 also includes a stop lug 26 which performs the dual functions of restraining holding arm 12 in a holding position on arrow shaft 24 whenever an arrow is drawn from a strung position, which position is a virtually linear conformation of bow string 30, and of limiting the pivotal movement of holding arm 12. In a strung position, the bow string 30 is fully into the nock 32 of the arrow and holding arm 12 is positioned in a start position. In a start position, holding arm 12 for the embodiment of FIG. 1 is bowed to provide a spring-like holding force to arrow shaft 24. For active archery activities such as the aforementioned game hunting and round target shooting, a certain amount of forward and rearward movement of the arrow shaft 24 is inevitable when the bow and arrow in strung position are jostled about as the archer runs or otherwise moves about. Stop lug 26 restrains holding arm 12 in the initial start position for any such rearward movement of an arrow shaft 24. A holding arm 12 not so restrained, could possibly follow an arrow shaft 24 to an extreme rearward position at which the arm applied no spring-like holding force which in turn might result in the holding arm remaining in the extreme rearward position as the arrow shaft moved forward with the result that an arrow could become unstrung as the arrow shaft 24 moved forwardly far enough for nock 32 and bowstring 30 to disengage. It has also been found that unlimited pivotal movement of a holding arm 12 can result in damage to the arrow vanes 34 in a manner more fully described hereinafter.

Figure 2:
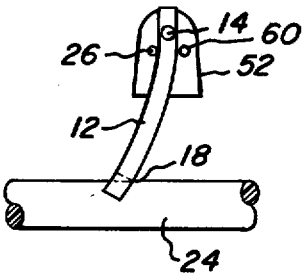
FIGS. 2, 3, and 4 are fragmentary side plan views of the arrow holder illustrated in FIG. 1.

FIG. 2 is a fragmentary, side plan view of an arrow holder 10 with the holding arm 12 in a start position. In the start position, arm 12 is slightly bowed and arcuate notch 18 contacts shaft 24 with sufficient friction to follow the shaft 24 forward. For an initial forward movement arm 12 becomes increasingly bowed to correspondingly increase the holding force applied to shaft 24.

Figure 3:
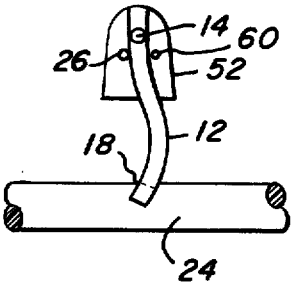

FIG. 3, also a fragmentary side plan view, illustrates holding arm 12 in the approximate position at which it is bowed maximum to apply a maximum holding force to shaft 24. FIG. 3, together with FIG. 2, graphically illustrate the variables relevant to specifying the critical parameters of the characterisitcs of holding arm 12. Holding arm 12 is selected of a hardness, thickness, length, and width to provide a holding force in the start position of FIG. 2 which is small enough that the drag on an arrow shaft is not likely to unstring an arrow for an archer who grips the nock 32 of an arrow very lightly between his fingers and also provides a maximum holding force at and near the position of FIG. 3 which does not interfere with proper release of an arrow, such as might particularly be the case with a finely adjusted bow of the class of bows known as compound bows and characterized in that the force applied by the bow string to the arrow is less at the fully drawn position than at an intermediate drawn position.

Figure 4:
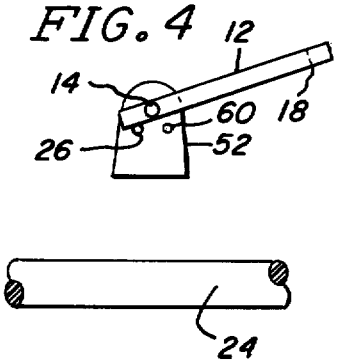

FIG. 4 is a further fragmentary side plan view and illustrates a holding arm 12 in its position of maximum forward pivotal movement. It has been found that if pivotal movement is allowed to approach three hundred sixty degrees, arcuate notch 18 may be struck by the leading edge of, and damage, a vane 34 of an arrow, to say nothing of deflecting the flight of the arrow.

Figure 5:
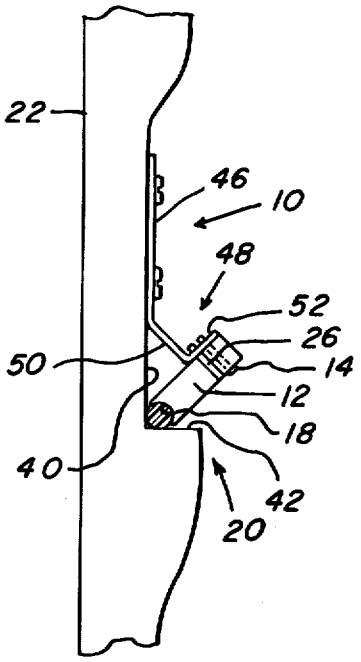
FIG. 5 is a side view of the arrow holder illustrated in FIG. 1.

FIG. 5 is a rear view of an arrow holder 10 of FIG. 1, but without an arrow in emplacement. The arrow has been omitted to illustrate the relationship between arcuate notch 18 and arrow rest 20, the latter of which comprises surfaces 40 and 42. From FIG. 5 it can be seen that a center-line bisecting the major surface of holding arm 12 would approximately pass through the juncture of surfaces 40 and 42 and would also bisect the arc of arcuate notch 18. Such an orientation of arm 12 to arrow rest 20 provides an optimum holding force from arm 12 to an arrow shaft 24.

FIG. 6 is a fragmentary rear view of an arrow holder 10 of FIG. 1. FIG. 6 illustrates the position differential for a basic position of arm 12 as illustrated in FIG. 3, for arcuate notch 18 with and without an arrow shaft held against arrow rest 20. The dashed line position and solid line positions of notch 18 respectively correspond to with and without an arrow shaft held in arrow rest 20. The full circle dashed line 45 in FIG. 6 corresponds to the circumference of an arrow shaft 24.

FIG. 7 is another fragmentary rear view of an arrow holder 10 of FIG. 1 which illustrates clearance of vanes 34 of an arrow under mounting bracket 16. For the preferred embodiment illustrated, bracket 16 comprises an elongate section 46 having a generally V-shaped appendage shown generally as 48. Sides 50 and 52 form appendage 50 and are nominally at right angles to each other. Side 50 extends at an angle of about 45 degrees from elongate section 46. As discussed above with reference to FIG. 5, the angles of sides 50 and 52 orient notch 18 relative to arrow rest 20 to provide an optimum holding force to an arrow shaft. Such angles also are nominally the optimum angles for providing substantially interference free flight of an arrow, and for minimizing the amount of material for bracket 22 and arm 12, although it can be seen from FIG. 7 that under ideal conditions perhaps further material minimization can be achieved as there is about a 15 degree differential between side 50 and the uppermost arrow vane 34. The illustration of FIG. 7 is not exact as the uppermost and lowermost vanes 34 tend to spread and increase their included angle as they strike surfaces 40 and 42 thus the exact angular differential between uppermost vane 34 and side 40 as an arrow shoots by side 40 varies according to factors including the flexibility of the vanes 34.

Figure 8:
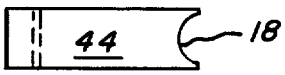
FIG. 8 is a plan view of a holding arm of the arrow holder of FIG. 1.
Figure 9:
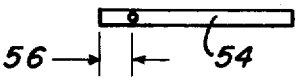
FIG. 9 is an edge plan view of the holding arm of FIG. 8.
Figure 10:
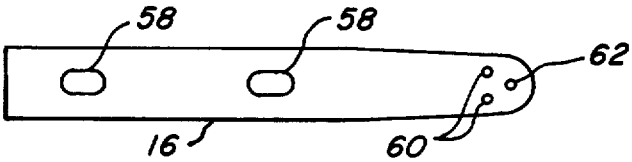
FIG. 10 is a prefabrication layout plan view of the mounting bracket of FIG. 7 prior to forming the bracket.

FIG. 8, 9, 10, and 11 are plan views of the principal components of the preferred embodiment arrow holder 10 of FIG. 1, drawn to scale. In FIG. 8, arm 12 is shown to have a major surface 44 which is generally rectangular except for the end which includes arcuate notch 18. FIG. 9 is an edge plan view of arm 12 illustrating a minor surface 54 and a minor length 56. FIG. 10 is a prefabrication layout drawing of a bracket 16, and, includes an illustration of mounting apertures 58 which are elongate for ease of mounting bracket 16 with arm 12 at the optimum attitude illustrated in FIG. 5. FIG. 10 also illustrates a pair of apertures 60 for insertion of a stop lug 26 (not shown).

Figure 11:
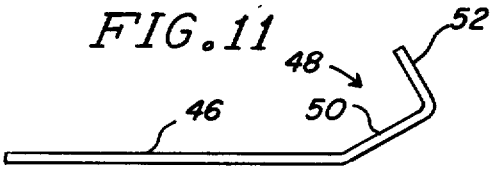
FIG. 11 is a side view of a mounting bracket of the arrow holder of FIG. 1.

Apertures 60 are symmetrically positioned with respect to aperture 62, an aperture for mounting pivot pin 14 (also not shown). Apertures 60 provide a bracket 16 which is universal for both left and right hand archers. FIG. 11 is a post fabrication side plan view of a bracket 22.

The best mode known for carrying out the invention is illustrated in the foregoing FIGS. 1 through 11 and has been assembled using the following components:

- arm 12: 85 durometer urethane having the following dimensions:

| | English | Metric Conversion |
|---|---|---|
| -thickness | 0.125 inch | 3.2 mm |
| -overall length | 1.281 inch | 32.6 mm |
| -minor length | 0.190 inch | 4.8 mm |
| -width | 0.375 inch | 9.6 mm |
| -notch radius | 0.175 inch | 4.4 mm |
| -pivot pin aperture | 0.070 inch | 1.75 mm |

- diameter of arcuate notch 18, nominally 0.275 inch (7 mm); it is expected that the diameter of notch 18 can vary from about 0.250 inch (6.4 mm) to 0.300 inch (7.6 mm) for a 0.340 inch (8.7 mm) diameter arrow shaft;

- pivot pin 14: ½ inch (12.5 mm) long by 1/16 inch (1.6 mm) diameter with a ⅛ inch (3.2 mm) head;

- mounting bracket 16: 1/16 inch (1.6 mm) thick by ½ inch (12.5 mm) wide cold rolled steel;

- stop lug 26: ½ inch (12.5 mm) long by 1/16 inch (1.6 mm) diameter.

To the extent there is any difference between the English and Metric units in the above table, the English units are to govern. The foregoing components are either readily available off the shelf components or may be easily and routinely manufactured from commonly available materials. The arcuate notch is, however, preferably machined as opposed to punched, for example, into the urethane strip.

An arm holder is assembled by inserting pivot pin 14 through arm 12 and press fitting the pin into bracket 16. Stop lug 26 is press fit into an aperture 60 according to whether the holder is for a right or left handed archer, of mounting bracket 16 and the bracket attached to a bow by wood screws, tape, or an adhesive. To use the arrow holder, an arrow is strung in the normal manner and arm 12 placed in the start position of FIG. 2. With arm 12 so positioned, and an arrow so emplaced, a holding force of at least a predetermined magnitude is applied to an arrow shaft to normally continously provide correct arrow emplacment while the bow and strung arrow are carried about in a non-shooting position, while an arrow is drawn to a fully-drawn position, and while an arrow is held in a fully-drawn position.

FIG. 12 is a perspective view of an arrow holder 10 used in combination with a removable arrow rest 64. These latter devices are reported to improve an archer's accuracy and may take a form such as the arrow rest in United States Pat. No. 3,499,414 which issued Mar. 10, 1970 to A. J. Frydenlund in which the arrow rest is illustrated generally as 6.

FIG. 13 is a perspective view of an alternative embodiment of an arrow holder 10 comprising a holding arm 70 pivotally secured by pivot pin 72 and including a catch 74. Arm 70 includes an arcuate notch 76 which together with side 78 of bow 80 hold arrow shaft 24 in emplacement. Notch 76 is selected to make sufficient contact with an arrow shaft and arm 70 is sufficiently flexible that upon shooting an arrow initial movement of arm 70 is by flexing of the arm as the arm follows the shaft forward until arm 70 clears catch 74 whereupon arm 70 pivots downwardly to release an arrow for free flight and clear the path of the arrow vanes. Bias means 82, a coil spring for the examplary embodiment of FIG. 13, may be provided which accelerates pivoting of arm 70 to the fully open position shwon generally as 84. The examplary embodiment of FIG. 13 is for a left handed archer.

The foregoing is given by way of illustration and not limitation and it is to be understood that various modifications and variations of the foregoing described embodiments are within the scope of the invention. For example, the arms 12 and 70 may be of a material other than urethane and pivot means such as a ball and socket could be substituted for the apertured arm 12 and pivot pin 14. Also, urethane of a hardness other than 85 durometers may be used, particularly if an offsetting change is made in another variable. For example, the holding force on an arrow generally varies directly with both hardness and length, consequently, an increase in hardness could be offset by an appropriate reduction of the arm major length (from pivot pin 14 to the notch 18 contact point with an arrow shaft).

Having described the invention and the manner and process of making and using the invention by means of the best mode contemplated for carrying out the invention, the true scope of the invention shall be defined by the following claims.

What is claimed is:

1. An arrow holder for continuously holding an arrow having a shaft, a nock on one end of the arrow and three vanes on the same end of the shaft as the nock, two of which vanes face toward a side of the bow when the arrow is in a strung position and the other of which vanes faces away from and is perpindicular to said bow side, in emplacement when the holder is attached to a bow and under virtually every condition including when a bow and strung arrow are being carried in a non-shooting position, while an arrow is being drawn to a fully-drawn position and while an arrow is being held in a fully-drawn position comprising:

means for holding an arrow shaft which means includes a bifurcated end; and, a pivot means for providing when said arrow holder is attached to a bow and an arrow is in proper emplacement pivotal movement of said arrow shaft holding means between positions providing engagement and disengagement of said bifurcated end with and from the arrow shaft, which bifurcated end cooperates with a bow member to apply a holding force of at least a predetermined magnitude to the arrow shaft when said bifurcated end is in engagement on the arrow shaft in a start position to hold the arrow in emplacement, which movement of said bifurcated end is in response to an initial forward movement of the shaft of said arrow to correspondingly move forward, and which pivoting of said holding means is in response to said bifurcated end's forward movement to pivot relative to said pivot means and disengage said bifurcated end from the arrow shaft whereby the cooperation between said bifurcated end and said bow member is broken to release an arrow for free flight.

2. An arrow holder according to claim 1 for a bow which includes an arrow rest formed by a pair of approximately perpindicular surfaces, wherein said arrow shaft holding means includes a flexible holding arm having a length and flexibility selected such that with the arrow holder attached to a bow, with an arrow in emplacement, and with said bifurcated end positioned closest to said arrow rest, said arm is bent to exert a spring-like compressional holding force against the arrow shaft to hold the arrow shaft against said arrow rest surfaces with sufficient force to continuously hold the arrow in shooting alignment under virtually all shooting conditions, including when the bow and arrow are being carried about in a non-shooting position, while the arrow is being drawn to a fully-drawn position, and while the arrow is being held in a fully-drawn position.

3. An arrow holder according to claim 1 wherein said holding arm is an elongate urethane strip and wherein said arrow shaft holding means further comprises a mounting bracket which is adapted for attachment to a bow and to which said urethane strip is secured by a pivot pin.

4. An arrow holder according to claim 3 wherein said bifurcated end is an arcuate notch in said urethane strip and said urethane strip is oriented relative to said arrow rest surfaces such that an axis common to a radius of the arcuate notch and passing through the mid-point of said notch approximately bisects the included angle of said surfaces.

5. An arrow holder according to claim 4 wherein said urethane strip has a hardness in a range from about 65 to 95 durometers.

6. An arrow holder according to claim 5 wherein said urethane strip has a hardness of 85 durometers.

7. An arrow holder according to claim 3 wherein said bifurcated end is an arcuate notch.

8. An arrow holder according to claim 3 wherein said mounting bracket comprises an elongate section for attachment to a bow and a generally v-shaped appendage, which appendage includes a pair of sides having surfaces the planes of which when the holder is attached to a bow are parallel to the axis of the shaft of an arrow in emplacement and which appendage surfaces intersect at an angle of nominally 90°, and one side of which appendage both extends from said section at an angle of about forty-five degrees and is of a length selected when the arrow holder is attached to a bow and an arrow is shot to provide minimum clearance beneath said one side of the arrow vane closest to said bracket as the arrow traverses said arm-rest, wherein said pivot pin is attached substantially normal to the other side of said appendage; wherein said urethane strip has a generally rectangular cross-section to provide a strip having major and minor surfaces; wherein said pivot pin is substantially mutually parallel with said major and minor surfaces; and wherein said arcuate notch is in the plane of said major surfaces whereby said urethane strip pivots in a plane including the axis of an arrow in emplacement.

9. An arrow holder according to claim 8 wherein said mounting bracket further comprises a stop lug for limiting pivotal movement of said arrow shaft holding means to sufficiently less than three-hundred sixty degrees whereby when the arrow holder is attached to a bow and an arrow is shot damage to arrow vanes otherwise resulting were the bifurcated end permitted to rotate into a position of alignment pointing toward the arrow nocked end and at an angle tending toward parallelity with the arrow shaft as the arrow vanes sped past the bow and into the bifurcated end of said arrow shaft holding means is prevented.

10. An arrow holder according to claim 9 wherein said stop lug comprises an extension from said appendage side to which said arrow shaft holding means is attached.

11. An arrow holder according to claim 1 wherein said arrow shaft holding means provides a holding force which increases for initial forward movement of an arrow.

12. An arrow holder according to claim 11 wherein said arrow shaft holding means includes an elongate holding arm which when the arrow holder is attached to a bow and with an arrow in emplacement is pivotable throughout an arc from an initial position providing engagement of said bifurcated end with and a holding force to the shaft of the arrow of at least a predetermined magnitude, through a position at which said bifurcated end provides a maximum holding force to the arrow shaft and which corresponds to a position of the arrow shaft forwardly of the position of the arrow shaft in said start position, and to a position at which said bifurcated end provides zero holding force to the arrow shaft.

13. An arrow holder according to claim 1 wherein said bifurcated end comprises a notch the open end of which when the holder is attached to a bow faces toward a side of said bow and catch means for holding said notch proximate to said bow side in a closed position when an arrow shaft is in emplacement to hold the arrow shaft in continuous shooting alignment and which arrow holder is responsive to shooting of the arrow to move to an open position in which said notch open end faces away from said bow side to release the arrow for free flight.

14. An arrow holder according to claim 13 wherein when attached to a bow side and with an arrow in emplacement said arrow shaft holding means is a holding arm adapted for initial movement in a first plane coinciding substantially with a plane passing through and including the shaft of the arrow, is adapted for hinge-like movement in a second plane approaching normal to said first plane and from said closed position to said open position at which said notch faces away from said bow side to break the cooperation between said bifurcated ends and said bow side, and which holding arm is responsive to release of an arrow to move in said first plane to a point beyond the influence of said catch means and includes bias means operative at said point to accelerate movement of said holding arm in said second plane to break the cooperation between said bifurcated end and said bow side and release a said arrow into free flight.

15. An arrow holder according to claim 14 wherein said notch is included in a holding arm, said catch means comprises an elongate finger for holding said holding arm for flexible movement between a start position and a release position, and which finger when the holder is attached to a bow side with an arrow in emplacement is oriented parallel to the arrow shaft and at an attitude to progressively increase the force applied by said notch to the arrow shaft as said holding arm flexes from said start to said release position.

* * * * *